United States Patent [19]

Pintar

[11] 4,069,014

[45] Jan. 17, 1978

[54] PROCESS AND APPARATUS FOR BLEACHING TEMPERATURE-SENSITIVE FIBERS

[75] Inventor: Enzo Pintar, Busto Arsizio, (Varese), Italy

[73] Assignee: Mezzera S.p.A., Milan, Italy

[21] Appl. No.: 698,996

[22] Filed: June 23, 1976

[30] Foreign Application Priority Data

Aug. 29, 1975 Italy ..... 26714/75

[51] Int. Cl.[2] ..... D06L 3/02

[52] U.S. Cl. ..... 8/111; 252/186; 424/62

[58] Field of Search ..... 8/111, 115.5; 424/62, 424/DIG. 3; 252/94, 102, 186

[56] References Cited

U.S. PATENT DOCUMENTS

| | | | |
|---|---|---|---|
| 2,395,311 | 2/1946 | Woodhouse et al. | 8/111 X |
| 3,350,161 | 10/1967 | Papini | 252/186 |
| 3,762,862 | 10/1973 | Cunningham et al. | 8/111 |

*Primary Examiner*—William E. Schulz

*Attorney, Agent, or Firm*—Sughrue, Rothwell, Mion, Zinn and Macpeak

[57] ABSTRACT

A process for bleaching fibers, particularly animal fibers which become damaged if their temperature rises too high, by applying to them a bleaching agent such as hydrogen peroxide the bleaching reaction of which releases heat sufficient to raise the temperature of the fibers above the temperature at which the fibers become damaged, in which the heat released by the reaction is absorbed by a material added in solid, powder, liquid or gaseous form to the fibers. The added material undergoes a chemical or physical change (such as a change of state) upon absorption of heat without rising in temperature. This allows the fibers to be held in bulk during bleaching without requiring to be spread out for the purpose of heat dissipation.

24 Claims, 2 Drawing Figures

PROCESS AND APPARATUS FOR BLEACHING TEMPERATURE-SENSITIVE FIBERS

Figure 1:
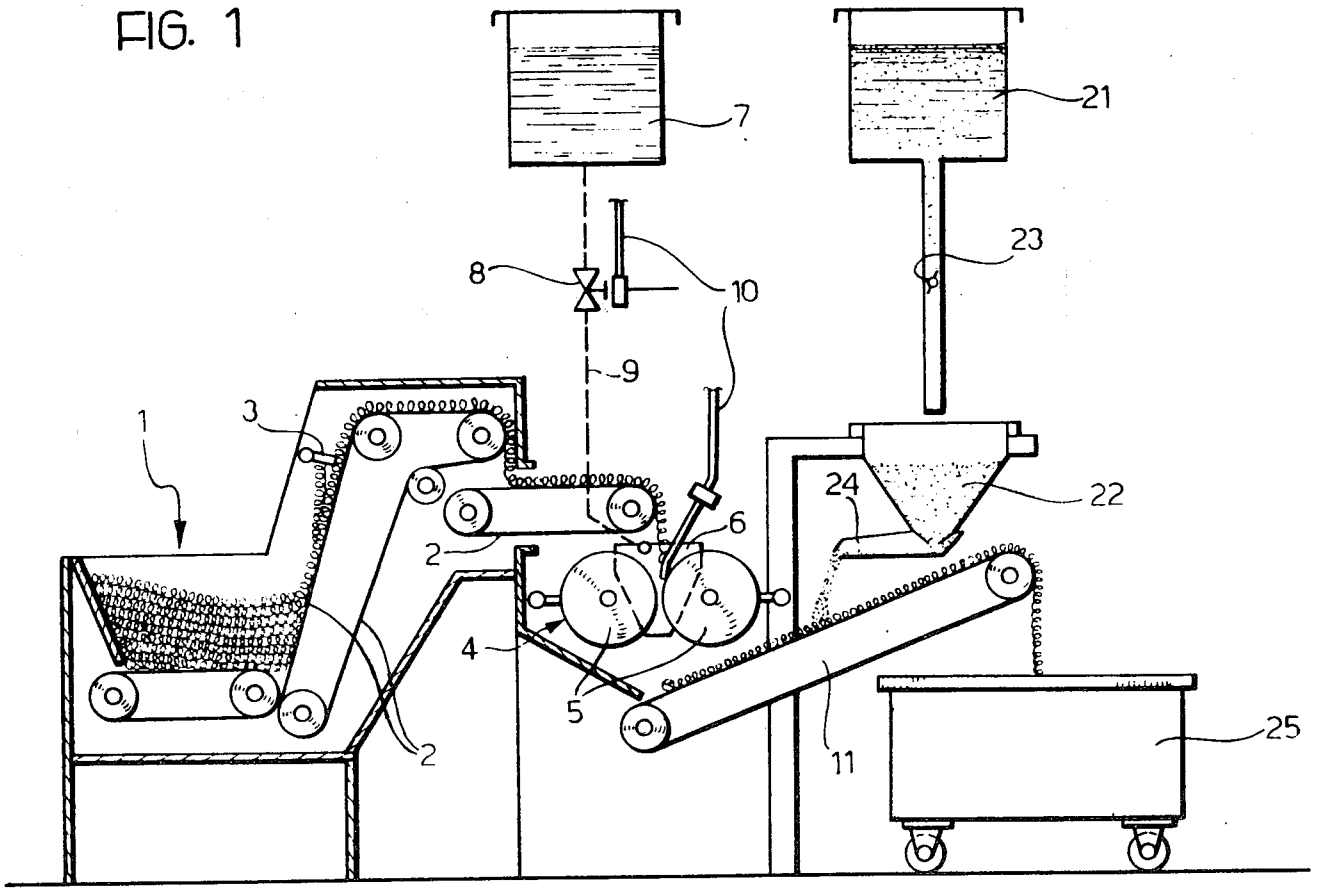

The present invention relates to a process for bleaching temperature-sensitive fibres, which is particularly applicable to animal or natural fibres such as, for example, wool fibres, in which the fibres are treated with a bleaching agent, (for instance, hydrogen peroxide) which bleaches the fibres slowly with simultaneous release of heat, and left in contact with the bleaching agent for an extended period. The present invention also comprehends apparatus for bleaching fibres in accordance with the process of the invention.

Fibres to be bleached may be in many forms, for example as unprocessed (uncarded or uncombed) staple, roving, thread or yarn, or as woven or knitted fabric. In practice many fibres, and in particular most animal fibres, require bleaching, either to remove dirt or to remove the natural colour of the fibres. In the case of wool fibres the most commonly used bleaching agent is hydrogen peroxide, and the standard process is a batch process in which the fibres are immersed in a bath containing hydrogen peroxide. The hydrogen peroxide in the bath can be alkaline (pH 8–9) and this is fairly quick acting, but wool in particular is chemically attacked to a certain extent leading to a decrease in dry weight, an increase in solubility in strong alkalis, and a decrease in the content of cystine (an amino acid); moreover the final colour of wool thus treated is slightly pink. Although this pink colour can be eliminated by using a subsequent reducing bath, the chemical change in the wool resulting from the chemical attack cannot be reversed.

In another process which has been used (on a smaller scale) the fibres are immersed in a bath of acid hydrogen peroxide (pH about 4) then removed from the bath and pressed to expel most of the hydrogen peroxide, bleaching then continues whilst the fibres are being further processed, for instance, combed or carded or while they are stored in small quantities. This process is milder than the alkaline hydrogen peroxide process and causes considerably less chemical change. However, the degree of bleaching achieved is not as good as that obtained with the alkaline process and furthermore the degree of bleaching can vary from batch to batch. In addition, when the fibres are allowed to continue bleaching while being further processed, the dampness of the fibres can make some of the subsequent operations difficult, and the acidity can attack parts of the machinery; if on the other hand the fibres are stored, a considerable amount of space is required because of the exothermic nature of the decomposition reaction of the hydrogen peroxide. If the fibres are kept in a large compacted mass the heat produced could raise the temperature excessively and not only damage the fibres chemically but also cause them to be less white.

If a large quantity of fibres, for example a quantity which could be loaded conveniently into a high-sided trolley, were treated in bulk with 130 volume hydrogen peroxide at 20° C in an ambient temperature of 22° C, the temperature of the wool in the middle would reach about 50° C after 16 hours, at which temperature chemical attack on the wool itself would start. At the end of a normal bleaching period of 24 hours, the temperature would have risen above 50° C: the resulting chemical attack is shown in the following table in which wool bleached in bulk is compared with wool bleached using a conventional bleaching process using two successive baths, that is a first with hydrogen peroxide and a second with a reducing agent bath, and with grey wool which has not been subjected to any bleaching.

TABLE 1

| Wool sample | Solubility in alkali, % by weight. | Solubility in urea/bisulphite % by weight. | Cystine content, % by weight. |
|---|---|---|---|
| Grey | 13.05 | 48.55 | 11.18 |
| Conventional bleaching | 28.10 | 53.25 | 10.42 |
| Bleaching in bulk | 56.45 | 63.95 | 8.80 |

It was also found that, in addition to having suffered chemical attack, wool bleached in bulk was not as white as that bleached in the conventional manner.

The problem which this invention seeks to solve is that of providing a process by which it is possible to bleach temperature-sensitive fibres in bulk using a bleaching agent which releases heat, for example hydrogen peroxide, which process is suitable to be carried out on a large industrial scale.

According to one aspect of the present invention, a process for bleaching temperature-sensitive fibres, in which the fibres are treated with a bleaching agent, such as hydrogen peroxide, which bleaches the fibres slowly and releases heat, in which the fibres are left in contact with the said bleaching agent for an extended period of time, comprises the further steps of adding to the fibres at least one substance which undergoes a chemical or physical change with the absorption of heat, and forming the treated fibres into a large mass so that the added substance is distributed throughout the mass of fibres, the added substance undergoing a physical or chemical change and absorbing the heat generated by the bleaching agent whereby at least to reduce the temperature rise of the mass of fibres during bleaching.

According to another aspect of the invention apparatus for bleaching fibres comprises a device for applying a liquid bleaching agent to the fibres, a conveyor for moving the fibres away from the bleaching agent applying device, means for adding to the fibres a heat absorbing substance which undergoes a chemical or physical change when absorbing heat, and means for forming the fibres into a large mass and for storing the fibres for an extended period to bleach.

With this invention it is possible to bleach fibres, particularly natural fibres to a degree of whiteness comparable, if not better than that achieved by using the conventional processes involving a treatment with hydrogen peroxide, followed by a reducing bath, or the process in which the fibres are immersed in hydrogen peroxide and the excess hydrogen peroxide is then expelled form the fibres by pressing.

The process of the present invention has a number of advantages, principally that the original chemical composition of the fibres can be largely maintained because the temperature during bleaching can be kept below the temperature at which chemical attack on the fibres occurs (and because a mild bleaching agent such as hydrogen peroxide can be used). Additionally, the process requires relatively limited space during the bleaching stage when the fibres can be held in large quantities, for example in large containers. The process can be easily and economically operated using only simple apparatus, and because the bleaching is not carried out in a bath, (and because the excess bleaching agent can be pressed out and recycled) the consumption of bleaching agent and water can be kept low. In some previously known bleaching processes, particularly those in which the fibres are held immersed in a bath, it is necessary to keep the fibres moving during the bleaching; this leads to a substantial risk of mechanical damage to the fibres. This is avoided in the process of the present invention since no such bath is used. Moreover the present invention is advantageous since it involves only a low consumption of electric power.

Another advantage, associated with the reduction of mechanical movement during the process, is the very low production of scrap or waste fibres during the bleaching (scrap or waste consisting of fibre dust, lint or similar fibre particles which separate from the main bulk of the actual fibres).

If required various other substances can be added to the fibres during the bleaching process such as, for example, moth-proofing substances or sequestering agents.

Preferably the process is performed by first applying an excess of bleaching agent to the fibres which are then passed through a press, for example, a roll press or foulard, which continually presses excess bleaching agent from the fibres. This excess can be economically recycled. The bleaching agent can be applied to the fibres in any convenient manner, preferably continuously.

The added substance is preferably a cheap material, but if a costly material is used, devices can be provided for recycling it. Preferably, the added substance is a solid material which absorbs heat when dissolved in the bleaching agent, and the preferred substance is urea, particularly granulated urea, because urea is readily available and easy to use. Alternatively, however, other solid materials can be used: examples of these are sodium chloride (common salt: NaCl), ammonium chloride ($NH_4Cl$), potassium sulphate, mercuric chloride, hydrated sodium acetate ($CH_3COON_a3H_2O$) and silver chloride.

The added substance may, however, be a solid material whose freezing or vapour point is lower than the temperature at which the fibres are damaged, that is to say, generally below 40° C. The most useful substance being, in this case, dry ice (solidified carbon dioxide: $CO_2$). This may be applied to the fibres in the form of a compressed gas and solidified in situ. Alternatively, a liquid whose boiling point is below the temperature at which the fibres become damaged may be used, the most convenient being methylene chloride ($CH_2Cl_2$). These liquid substances can be mixed with the bleaching agent before it is applied to the fibres.

In theory, the added substance could be a compressed gas, such as compressed carbon dioxide, which cools the fibres simply by expansion, without necessarily forming a solid.

Figure 2:
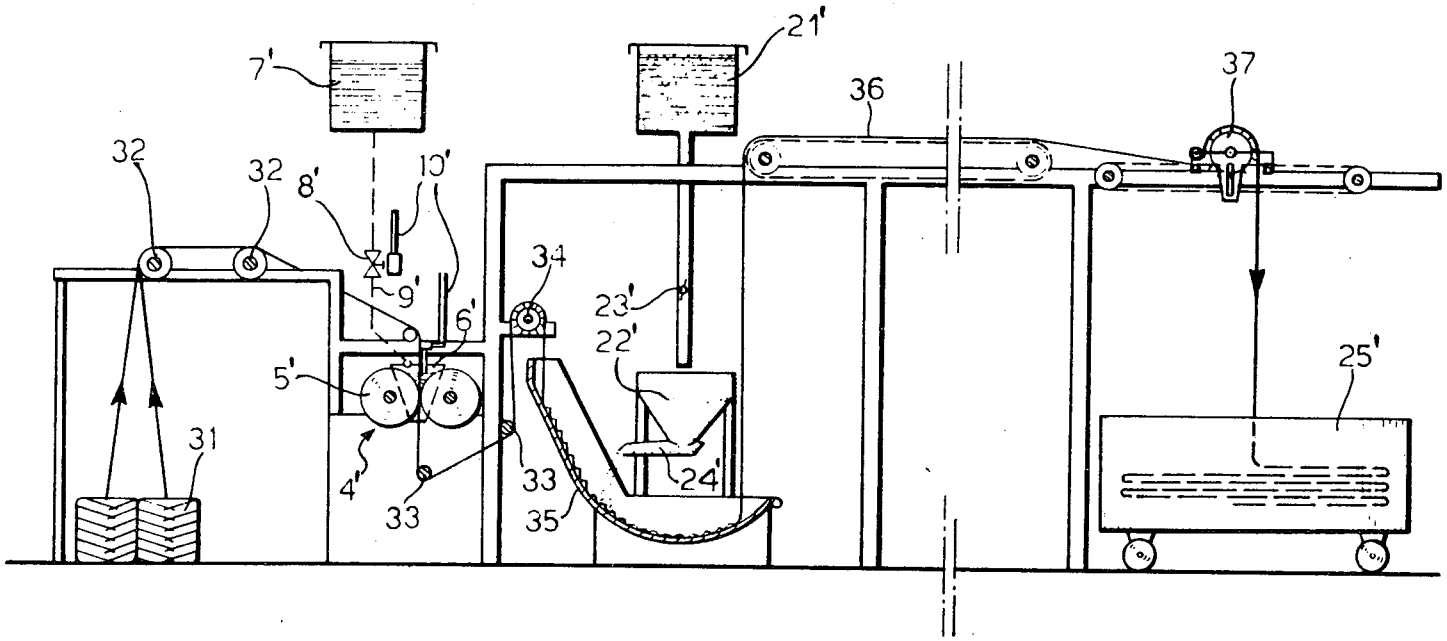

The invention will now be more particularly described, by way of example, with reference to the accompanying drawings, in which:

FIG. 1 is a side view, partly in vertical section, of a first embodiment of the invention comprising apparatus for bleaching unprocessed wool; and FIG. 2 is a side view, partly in vertical section, of a second embodiment of the invention, this embodiment comprising apparatus for bleaching wool tops.

Referring now to FIG. 1 the apparatus shown comprises a hopper 1 into which the grey untreated wool is loaded, and a conveyor belt system 2 for removing the grey wool from the hopper and conveying it forward through the apparatus. A doctor blade 3 is provided just above the conveyor 2 where it leaves the hopper 1 for spreading the grey wool out in a fairly uniform layer.

The layer of grey wool is fed to a roll press or foulard 4 which comprises a pair of rolls 5 and a reservoir for the bleaching agent which is formed by the upper parts of the rolls 5 and side cheeks 6. The bleaching agent is supplied from a tank 7 by means of a feed pipe 9 provided with a control valve 8 which is actuated by any suitable level sensor schematically indicated by the reference numeral 10 in FIG. 1. The pressure between the rolls 5 is adjusted so as to squeeze out any excess bleaching agent from the grey wool, this excess bleaching agent being held in the reservoir above the rolls 5, whilst any bleaching agent which flows through the rolls 5 and drips from them or from the wool can be collected in a suitable collecting tray (not shown) and recycled to the tank 7.

After passing through the roll press or foulard 4, the layer of grey wool drops onto a conveyor device in the form of a belt conveyor 11 which carries it under a device 21, 22, 23, 24 for adding substances to the wool.

The device 22, 24 shown by way of example in FIG. 1 is a device equipped for sprinkling a powdery or granular substance onto the layer of wool; this device comprises a main feed container 21 from which the substance is fed through a conduit controlled by a valve 23, into a hopper 22. The hopper 22 discharges into a vibratory chute 24 which may be provided with a screen, sieve or the like to sprinkle the substance in a uniform manner onto the surface of the layer of grey wool being carried past on the conveyor belt 11. The vibratory chute 24 and the sieve or screen operate to regulate the rate of feed of the substance onto the wool: it will be appreciated that instead of a vibratory chute 24, any other suitable device may be used, for example an Archimedes screw.

At the end of the conveyor belt 11, the grey wool, dampened with the bleaching agent and carrying the added substance, drops into a high-sided trolley 25 the position of which can be adjusted while being filled so as to ensure that it is loaded. The trolley 25 has a capacity of, for example, two cubic metres and will thus hold about 400 kgs. dry weight of grey wool. When the trolley is full it is moved to a storage area where it can be left for 24 hours while the wool bleaches, and another trolley 25 is placed at the end of the conveyor belt 11 in its place. At the end of the 24 hour bleaching period, the wool is washed, rinsed and dried in equipment which is not shown but which may be of any conventional type.

It will be appreciated that the apparatus of FIG. 1 can be adapted for treating wool fibres while they are in any form, for instance, wool tops, yarn, thread or fabric.

FIG. 2 illustrates apparatus adapted for the treatment of wool fibres in the form of tops, that is to say fibres carded and combed to form a roving but not fully drafted and spun. In FIG. 2 the component parts of the apparatus which correspond exactly or generally to those in FIG. 1 are indicated with the ame reference numerals, but primed; these parts are not described again in detail for the avoidance of unnecessary repetition.

The tops can be simultaneously drawn from bobbins 31 and distributed side-by-side along the length of support and guide rolls 32. After passing through a roll press or foulard 4', the grey wool tops are continuously carried forward by a conveyor arrangement which includes further guide rolls 33, a rotary beam 34 having spikes or pins for drawing the tops along, and a chute 35 down which the tops slide to the bottom where they fold-up slightly. While the tops move down the chute 35, a heat absorbing substance is sprinkled onto them by means of a suitable device, after which the tops are drawn by means of a conveyor chain 36 which conveys them to a carriage 37 which moves with a reciprocating rectilinear movement like a conventional folding device. This device loads the said tops into a trolley 25' in superimposed pleats or folds. The invention will now be further described by way of the following examples:

EXAMPLE I

Using the apparatus of FIG. 2, grey wool tops were treated with a bleaching agent at 18°–20° C made up as follows for each litre of bleaching solution (the pH being adjusted to 4):

| | |
|---|---|
| 130 volume hydrogen peroxide | 60 cc |
| surface active agent | 5 cc |
| anti-foaming agent | 0.5 cc |
| Polyacronitrillic acid thickening agent | 2 gms |
| Agent for sequestering metal salts | 1 gm |
| Water to make up to | 1000 cc |

The tops were roll pressed to leave a weight ratio of dry unbleached wool/bleaching solution of between 1:1 and 1:1.3 and conveyed at a linear velocity of 20 meters per minute past the vibratory chute 24' where granulated urea was sprinkled on the tops. The tops were left in the trolley for 24 hours without supplementary cooling, the average ambient temperature being 20° C; the temperature rise during this stage of bleaching was recorded. The tops were then washed, rinsed and dried.

EXAMPLE II

Exactly the same procedure as in example 1 was followed except that the bleaching liquid included between approximately 2 gm and approximately 5 gm of optical whitening per litre of bleaching solution.

The temperature rises experienced during bleaching with different amounts of urea added to the wool are set out in Table II.

TABLE II

| Urea per Kg of dry wool - gms. | Temperature after 12 hours | Temperature after 24 hours |
|---|---|---|
| 33 | 28° C | 28° C |
| 50 | 26° C | 26° C |
| 100 | 21° C | 21° C |
| 120 | 20° C | 20° C |

Table III illustrates the effects of the chemical change which occured in the original structure of wool bleached in the manner described in example I in comparison with the changes occurring in wool bleached in the conventional manner, that is, using the process mentioned above comprising treatment in an alkaline bath of hydrogen peroxide and a subsequent reduction bath: the quantity of hydrogen peroxide used in the method of Example 1 was varied, and the quantity of added urea was 50 gms per Kg. of dry grey wool.

TABLE III

| Wool sample | Solubility in alkali, % by weight | Solubility in urea/bisulphite, % by weight | Cystine content, % by weight |
|---|---|---|---|
| Grey wool | 10.8 or 13.7 | 55.5 or 55.6 | 12.54 |
| Bleached conventionally | 25.1 or 27.4 | 61.1 or 60.8 | 11.62 |
| Bleached as in Ex. 1 25 cc/l. $H_2O_2$ | 14.9 or 14.5 | 52.2 or 54.7 | 12.12 |
| Bleached as in Ex. 1 75 cc/l. $H_2O_2$ | 16.9 or 15.0 | 54.6 or 58.4 | 12.02 |
| Bleached as in Ex. 1 100 cc/l. $H_2O_2$ | 19.5 or 19.6 | 59.2 or 58.9 | 11.68 |

EXAMPLE III

The bleaching solution used, the temperature, the degree of pressing and the speed of the roll press or foulard 4' were all exactly the same as in example 1. However, the wool to be bleached was made to drop directly from the roll press or foulard 4' into the trolley 25', and the device for applying the heat absorbing substance to the wool was an expansion nozzle for feeding compressed carbon dioxide gas onto the wool as it dropped into the trolley 25' in such a way as to form dry ice on the wool. It was found that when 20 gms of dry ice for every Kg of dry grey wool was used, the temperature remained within the range of 20°–22° C during the whole of the bleaching stage.

EXAMPLE IV

The process of example 111 was repeated except that instead of using dry ice, the reservoir above the rollers 5' was supplied with amounts of methylene chloride varying from 150 cc to 200 cc per litre of bleaching solution. For any value within this range, the temperature remained practically constant.

What is claimed is:

1. A process for bleaching temperature-sensitive fibres, said process comprising the steps of:

applying to said fibres a bleaching agent which bleaches the fibres slowly and releases heat, adding to said fibres at least one substance which undergoes a chemical or physical change with the absorption of heat, collecting the treated fibres into a large mass such that said added substance is distributed throughout the mass of fibres, and leaving the fibres in contact with said bleaching agent and said added substance for an extended period during which said added substance undergoes a physical or chemical change and absorbs the heat released by said bleaching agent whereby at least to reduce the temperature rise of the mass of fibres during bleaching.

2. A process as in claim 1, wherein said heat absorbing substance is added to said fibres in sufficient quantity to maintain the temperature of said fibres substantially at the ambient temperature during bleaching.

3. A process as in claim 1 wherein said bleaching agent is applied in a manner such as to saturate said fibres, said fibres then being passed through a press to press out the excess bleaching agent therefrom.

4. A process as in claim 1, wherein said bleaching agent is continuously applied to said fibres.

5. A process as in claim 1, wherein said bleaching agent is hydrogen peroxide.

6. A process as in claim 1, wherein said added substance is a material which absorbs heat on dissolving in the bleaching agent.

7. A process as in claim 6, wherein said heat absorbing added substance is urea.

8. A process as in claim 7 wherein said urea is added to the fibres in a quantity of between 35 and 100 gms. per Kg of dry fibres.

9. A process as in claim 1, wherein said heat absorbing added substance is one which undergoes a change of state at a temperature lower than that at which the fibres become damaged.

10. A process as in claim 1, wherein said heat absorbing added substance is a salt.

11. A process as in claim 10, wherein said heat absorbing added substance is sodium chloride.

12. A process as in claim 10, wherein said heat absorbing added substance is ammonium chloride.

13. A process as in claim 10, wherein said heat absorbing added substance is potassium sulphate.

14. A process as in claim 10, wherein said heat absorbing added substance is mercuric chloride.

15. A process as in claim 10, wherein said heat absorbing added substance is hydrated sodium acetate.

16. A process as in claim 10, wherein said heat absorbing added substance is silver chloride.

17. A process as in claim 1, wherein said heat absorbing added substance is a solid material the freezing point of which is lower than the temperature at which said fibres may be damaged.

18. A process as in claim 17, wherein said heat absorbing added substance is added to the fibres in the form of a compressed gas or liquid which solidifies in situ.

19. A process as in claim 17, wherein said heat absorbing added substance is dry ice ($CO_2$).

20. A process as in claim 1, wherein said heat absorbing added substance is a liquid the boiling point of which is lower than the temperature at which the fibres may be damaged.

21. A process as in claim 20, wherein said heat absorbing added substance is mixed with said bleaching agent prior to the application of said bleaching agent to said fibres to be bleached.

22. A process as in claim 20, wherein said heat absorbing added substance is methylene chloride.

23. A process as in claim 1, wherein said heat absorbing added substance is a compressed gas, the expansion of said gas upon absorbing heat providing the cooling effect without involving a change of state.

24. A process as in claim 23, wherein said heat absorbing added substance is carbon dioxide.

* * * * *